United States Patent [19]

Govang et al.

[11] Patent Number: 4,509,648

[45] Date of Patent: Apr. 9, 1985

[54] MERCHANDISING DISPLAY SYSTEM AND COMPONENTS THEREFOR

[75] Inventors: James A. Govang, Clinton; William W. Mee, New Canaan, both of Conn.; Robert S. de Gruchy, Massapequa, N.Y.

[73] Assignee: The Stanley Works, New Britain, Conn.

[21] Appl. No.: 401,970

[22] Filed: Jul. 26, 1982

[51] Int. Cl.[3] ..... A47F 5/08

[52] U.S. Cl. ..... 211/70.6; 211/59.1; 211/87; 248/220.2; 248/220.4

[58] Field of Search ..... 211/60 T, 59.1, 57.1, 211/106, 87; 248/220.3, 220.4, 221.1, 221.2, 222.1, 220.2

[56] References Cited

U.S. PATENT DOCUMENTS

| | | | |
|---|---|---|---|
| Re. 29,002 | 10/1976 | Govang | 211/59.1 |
| 1,229,716 | 6/1917 | Clark . | |
| 2,100,421 | 3/1932 | Wupper | 248/220.3 |
| 2,842,264 | 3/1955 | Larson | 248/221.2 |
| 2,971,653 | 8/1958 | Shaw | 248/220.3 |
| 3,002,630 | 5/1960 | Heisser | 211/65 |
| 3,045,961 | 12/1958 | Cygan | 248/221.2 |
| 3,112,912 | 6/1962 | Alvarez . | |
| 3,172,540 | 3/1965 | Berge | 211/87 |
| 3,235,218 | 2/1966 | Graham | 248/220.3 |
| 3,268,195 | 8/1966 | Hoffman | 248/220.3 |
| 3,497,079 | 2/1970 | Kulwiec | 248/220.3 X |
| 3,698,565 | 10/1972 | Weber | 211/87 |
| 3,976,201 | 8/1976 | Hodgson et al. | 248/220.4 |
| 3,985,325 | 10/1976 | Ginsburg et al. | 248/220.4 |
| 4,008,872 | 2/1977 | Thompson | 248/224.2 |
| 4,018,341 | 4/1977 | Jarecki | 248/220.4 |
| 4,094,415 | 6/1978 | Larson | 248/220.3 |
| 4,113,109 | 9/1978 | Donnelli et al. | 248/221.1 |
| 4,436,209 | 3/1984 | Thalenfeld | 211/57.1 |

FOREIGN PATENT DOCUMENTS

| | | | |
|---|---|---|---|
| 2331906 | 1/1974 | Fed. Rep. of Germany | 248/220.4 |

*Primary Examiner*—Robert W. Gibson, Jr.

[57] ABSTRACT

A merchandise display assembly for use with perforated panel board and the like includes hanger brackets with upstanding arms to seat in the apertures of the pegboard and horizontally extending ledge portions. A panel member having a multiplicity of horizontally extending track portions is carried on the hanger brackets by seating of a track portion on the ledge portions thereof. The track portions have channels opening on the front face thereof, and clip members having vertically spaced legs are seated in the channels. These clip members in turn seat hooks which will carry "carded" product, shelf members for supporting product, and display hooks.

21 Claims, 10 Drawing Figures

MERCHANDISING DISPLAY SYSTEM AND COMPONENTS THEREFOR

BACKGROUND OF THE INVENTION

Merchandising displays are widely employed for point-of-sale mounting of articles mounted on cards or the like to facilitate customer examination and location as well as to create customer interest. Such displays frequently use perforated panel board or the like as a wall support, and hooks or hangers of various sizes and configurations to suspend or otherwise mount "carded" merchandise. Some employ labels on the perforated panel board or on special hangers with panels therefor to provide information concerning price. Some manufacturers provide instructions or templates to assist the retailer in creating effective displays of this type, such as for example the type illustrated in Govang U.S. Pat. No. Re. 29,002 granted Oct. 12, 1976.

Many of these displays do not provide an attractive background for the displayed product. Moreover, the hangers frequently do not provide stable mounting for the heavier products. Some displays are costly and fail to provide versatility.

It is an object of the present invention to provide a novel and highly versatile merchandising display assembly which is rugged in assembly and providing means for displaying a wide range of products.

It is also an object to provide such a display assembly utilizing components which may be fabricated relatively economically and in varying sizes and configurations.

Another object is to provide such a display wherein the components may be disassembled relatively easily and relatively easily reassembled in an alternate pattern to effect a new display.

SUMMARY OF THE INVENTION

It has now been found that the foregoing and related objects may be readily attained in a merchandise display assembly of the type adapted to be mounted upon a perforated vertical member such as perforated panel board and including a plurality of panel mounting brackets and a panel member supported thereon. The brackets each have a body portion providing an upwardly and outwardly inclined ledge and a multiplicity of spaced finger portions extending upwardly from the body portion and adapted to engage in the apertures of an associated perforated panel board such as such as that sold under the trademark PEGBOARD.

The panel member has a front face defined by a multiplicity of web portions lying in a common plane and a multiplicity of vertically spaced track portions extending horizontally therebetween. The track portions provide channels opening at the front face and inclined downwardly therefrom, and each of the track portions has a bottom wall and a top wall. The track portions are exposed on the rear face of the panel and the inclined ledges of the panel brackets seat the bottom walls of the track portions of the panel member for supporting the panel member on the associated perforated member.

Disengageably seated in spaced relationship in the channels of the panel member are a a multiplicity of clip members, each having a body portion disposed adjacent a web portion of the panel member. A plurality of laterally spaced upper legs are inclined downwardly and inwardly from the body portion and extend into a first channel, and a lower leg inclined downwardly and inwardly from the body portion extends into a second channel spaced below the first channel. The legs are configured to seat securely within the channels, and the body portion has at least one vertically disposed recess therein opening on the upper surface thereof. Seated in the clips are a multiplicity of display hooks, each having at least one arm portion extending away from the panel and a depending leg portion on the inner end of the arm portion seated in one of the recesses in the body portion of the clip members.

Desirably, the merchandise display assembly additionally includes label members detachably secured to the web portion of the panel member for identifying the products to be displayed on a contiguous hook. Also provided are label hooks having at least one arm portion extending away from the panel, a depending leg portion at its one end seated in a recess of a clip, and a generally vertically disposed label panel member at its outer end. The label panel is adapted to carry display indicia associated with the products to be displayed on a contiguous display hook.

In a preferred embodiment, the mounting brackets each have a support flange portion extending downwardly from the body portion to stabilize the bracket on the associated perforated panel board or like support. This flange portion has a projection thereon which seats in a track portion to stabilize the mounting of the panel thereon. Desirably, a flange portion is provided at each end thereof.

In its preferred embodiment, the panel has side walls at the ends of the front face and each of the track portions has an end wall at the base of the channel. The top wall and end wall of each of the track portions has a multiplicity of recesses spaced therealong opening into the channels and the upper legs of the clips have hook portions which engage in said recesses. Moreover, the top wall of the track portions is inclined at a steeper angle than the bottom wall to decrease the vertical dimension of the channels at their inner end.

In addition, the assembly may include a shelf member having a base wall and a sidewall, and a shelf mounting hook member having a pair of horizontal arm portions with depending leg portions at the inner ends seated in a pair of recesses of a clip member. The base wall includes means for engaging the arm portions of the hook member, and such means conveniently comprises opposed ribs into which the arm portions snap fit. The arm portions are desirably inclined downwardly to gravity feed product stored on the shelf members to the outer end thereof.

DETAILED DESCRIPTION OF THE ILLUSTRATED EMBODIMENTS

Figure 1:
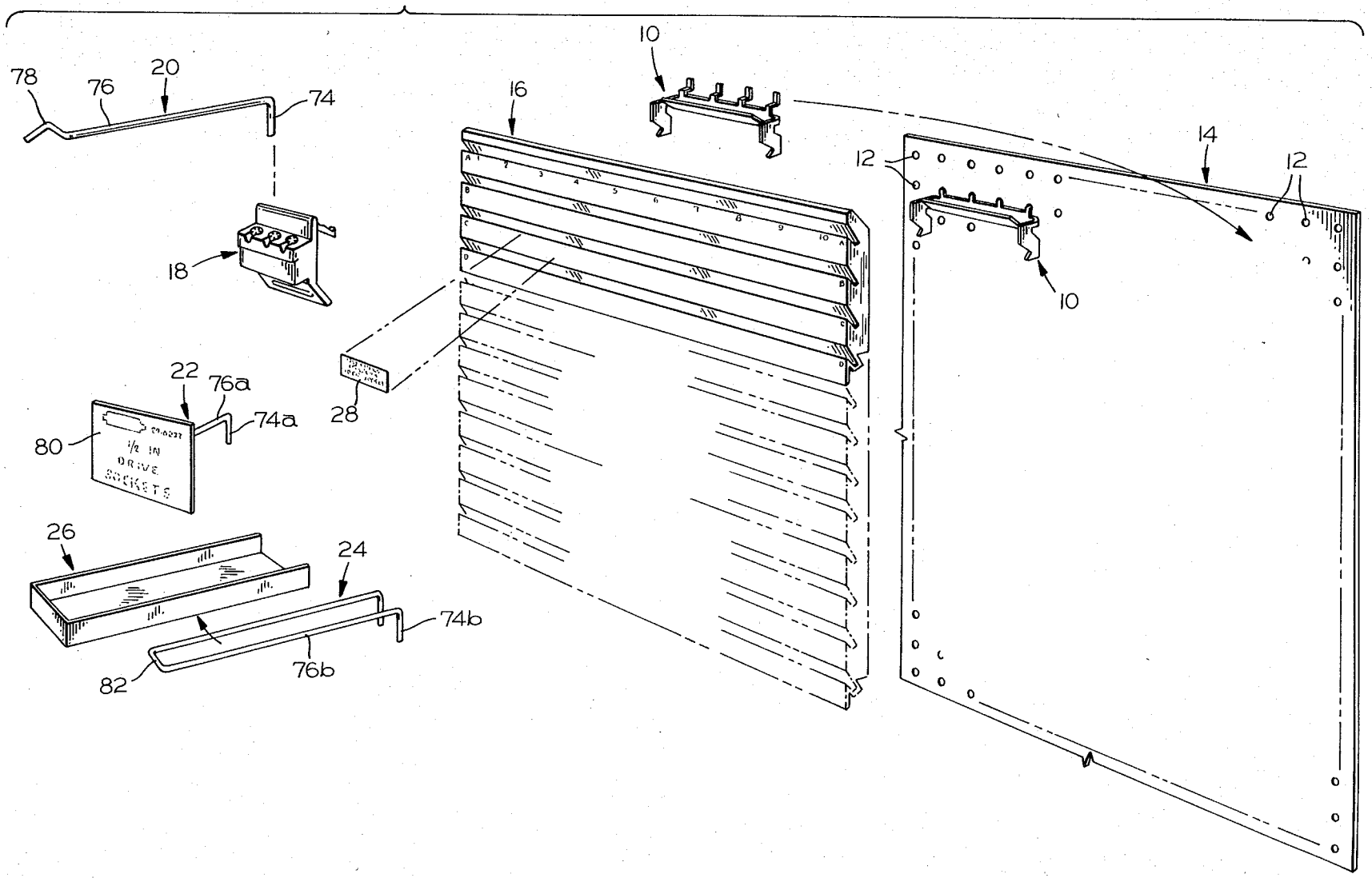
FIG. 1 is a partially exploded perspective view of a merchandise assembly embodying the present invention with one panel mounting bracket mounted on a fragmentarily illustrated perforated panel board.

Turning first to FIG. 1, the several elements of mechandise display assembly embodying the present invention include panel mounting brackets generally designated by the numeral 10 which seat in apertures 12 of the perforated panel board generally designated by the numeral 14. The brackets 10 support the panel member generally designated by the numeral 16. Seated on the panel member 16 are clip members generally designated by the numberal 18 (only one of which is illustrated) which in turn seat display hooks generally designated by the numeral 20, label hooks generally designated by the numeral 22, and shelf mounting hooks generally designated by the numeral 24 and which carry shelf members generally designated by the numeral 26. Also affixed to the front face of the panel member 16 are indicia bearing labels 28.

Figure 2:
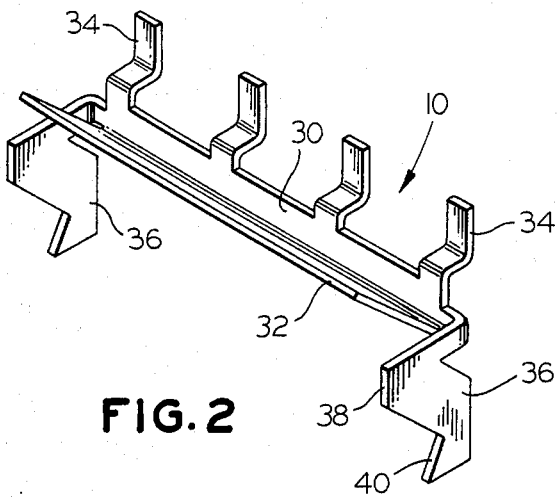
FIG. 2 is a perspective view to an enlarged scale of the panel mounting bracket of FIG. 1.
Figure 6:
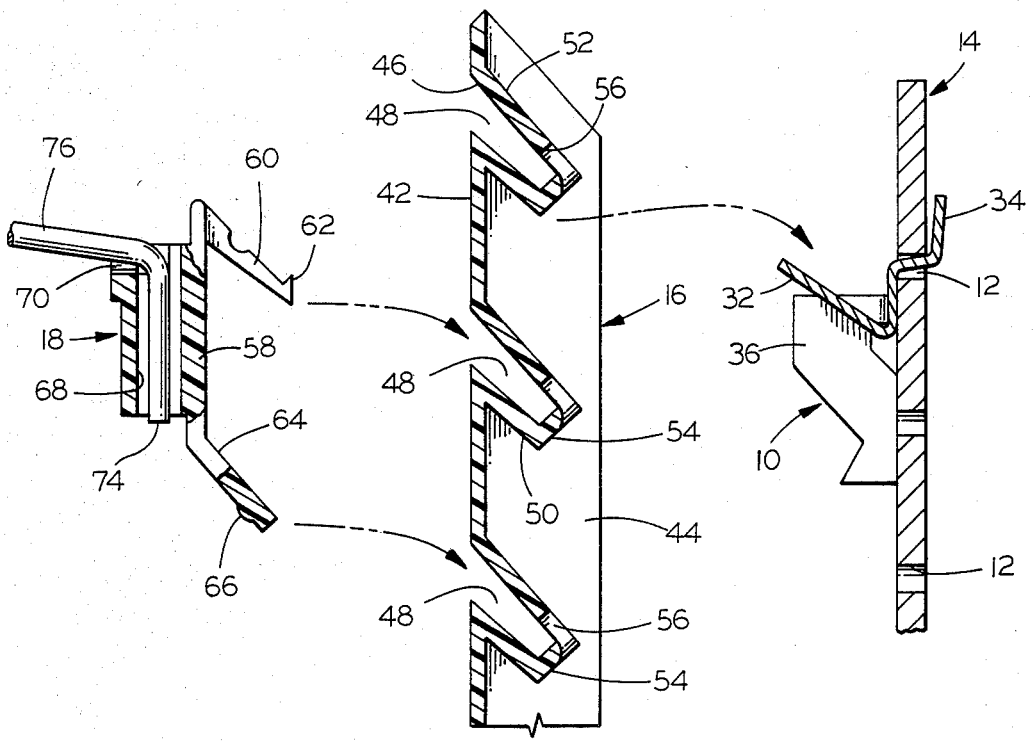
FIG. 6 is a partially exploded fragmentary vertical section of the assembly of FIG. 1 drawn to an enlarged scale.
Figure 8:
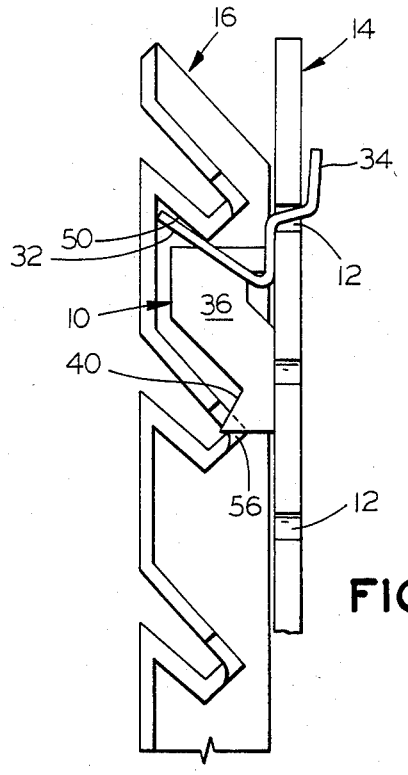
FIG. 8 is a fragmentary vertical sectional view of the bracket/perforated panel board/panel subassembly in which the cross hatching has been omitted for clarity of illustration.

Turning now in detail to the panel mounting bracket 10, as seen in FIG. 2, it is conveniently stamped from sheet metal. The bracket 10 has an elongated body portion 30 providing an upwardly and outwardly inclined ledge 32, and a multiplicity of spaced finger portions 34 extend upwardly from the body portion 30 and are of generally S-shaped configuration. At each end of the body portion 30 are support flanges 36 which extend downwardly therefrom and which have their principal plane extending generally perpendicular to the plane of the body portion 30. The flanges 36 extend outwardly from the rear of the body portion 30 a distance approximating that of the front end of the ledge 32 to provide an abutment surface 38 disposed therebelow. The front or outer edge of the flanges 36 extends downwardly and inwardly from the abutment surface 38 and then outwardly again to provide a projection 40. As seen in FIGS. 6 and 8, the finger portions 34 mount in the apertures 12 of the perforated panel board 14 so that the body portion 30 and rear edges of the flanges 36 bear against the front surface of the perforated panel board 14.

Figure 5:
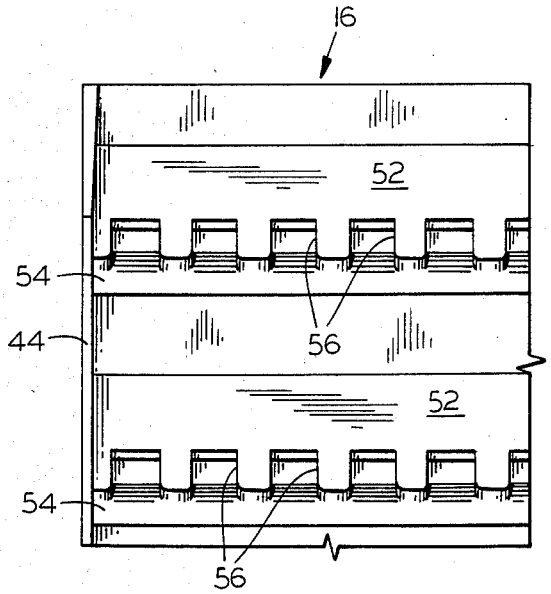
FIG. 5 is a fragmentary rear elevational view of the panel of FIG. 1.
Figure 7:
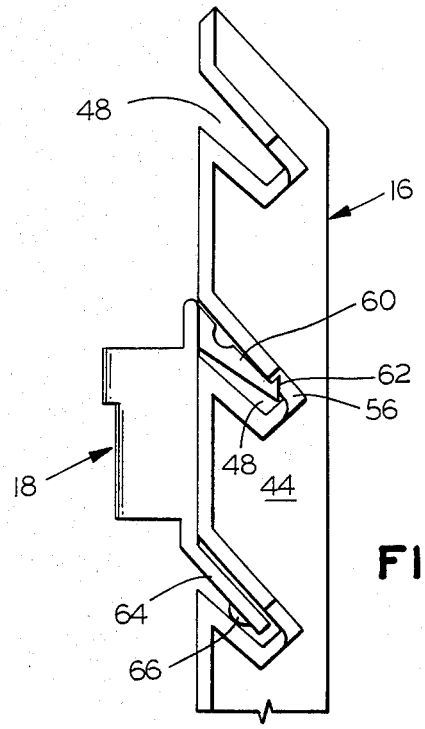
FIG. 7 is a fragmentary vertical sectional view of the panel/clip subassembly in which the cross hatching has been omitted for clarity of illustration.

Turning now to the panel member 16, as seen in FIGS. 5–7, it has a front face or wall 42, sidewalls 44 and a multiplicity of vertically spaced track portions 46 which extend horizontally from side to side and provide downwardly and inwardly inclined channels 48 opening at the front face 42. The track portions 46 each have a bottom wall 50, a top wall 52, and a base wall 54 at the bottom of the channel 48. Formed in the top wall 52 and base wall 54 are a multiplicity of recesses or notches 56 opening into the channel 48 and spaced along the length of each track portion 44. As seen in FIG. 8, the panel mounting brackets 10 seat and support the panel member 16 by the seating of the bottom wall 50 of the track portion 44 on the ledge 32 thereof, and stability is provided by the disposition of the projections 40 in the notches 56. Moreover, the rear edges of the side walls 44 are closely adjacent or abut the front face of the perforated panel board 14.

Figure 3:
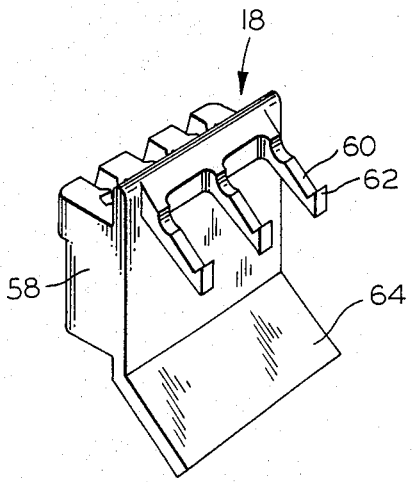
FIG. 3 is a perspective view to an enlarged scale of the clip of FIG. 1.
Figure 4:
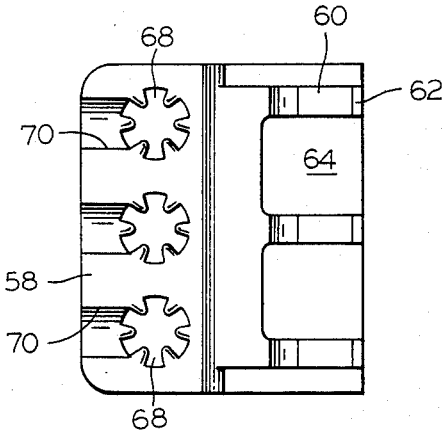
FIG. 4 is a top view of the clip.

Turning now to the clip members 18, as seen in FIGS. 3, 4, and 6, they have a body portion 58 and horizontally spaced upper legs 60 which are inclined downwardly and rearwardly from the upper margin of the body portion 58 and which terminate in upstanding hooks 62. At the lower margin of the body portion 58 is a continuous lower leg 64 which is inclined downwardly and rearwardly and which has an elongated, generally semicylindrical boss 66 on its lower surface adjacent its free end. Extending vertically within the body portion 58 and opening on its top surface are a multiplicity of ribbed apertures 68, and the top surface of the body portion 58 has arcuate channels or grooves 70 extending from the apertures 68 to the front face thereof. As best seen in FIGS. 6 and 7, the angle of inclination of the lower leg 64 is greater than that of the upper legs 60. As a result, when the clip 18 is seated on the panel member 16, the hooks 62 on the upper legs 60 snap into the notches 56 of the track portion 46 and the legs 60, 64 are resiliently deflected to increase the resistance to disengagement.

Various of the hooks 20, 22, and 24 may seat in the apertures 68 of the clip members 18. Turning first to the display hook 20, it has a depending leg 74 at its inner end which seats in the aperture 68 and an elongated horizontal arm portion 76 extending therefrom and disposed in the channel 70. Adjacent its outer end, the arm portion 76 has an inverted V-shaped portion 78 to provide an abutment or stop for display packages hung thereon.

The label hook 22 also has a depending leg portion 74*a*. At its outer end, the arm portion 76*a* has a metal panel 80 welded or otherwise secured thereto and which is adapted to bear indicia, as seen in FIG. 1.

The self mounting hook 24 has a pair of elongated arm portions 76*b* interconnected at their outer end by the web 82 and having depending leg portions 74*b* at their inner ends. Moreover, as seen in FIG. 10, the arm portions are inclined downwardly from their intersection with the leg portions 74*b*.

Figure 10:
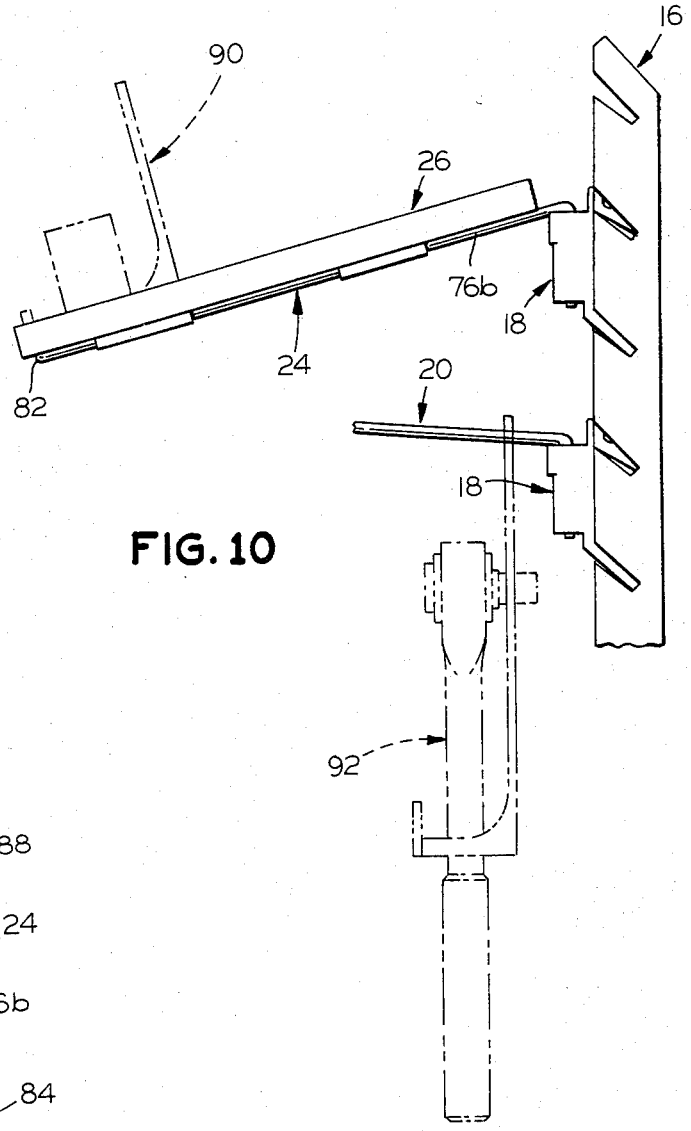
FIG. 10 is a fragmentary side elevational view of the assembly of FIG. 1 showing a package in phantom line in the tray and another package in phantom line hanging from a hanger.
Figure 9:
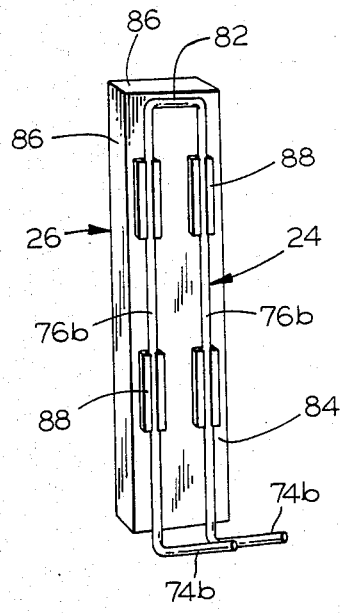
FIG. 9 is a bottom perspective view of the hanger/-tray subassembly of FIG. 1 drawn to an enlarged scale.

Turning now to the shelf member 26, as best seen in FIGS. 9 and 10, it is conveniently integrally molded with a bottom wall 84 and a sidewall 86 extending about its outer end and along its sides; no sidewall portion is provided at the inner end. On the lower surface of the bottom wall 84 are formed two pairs of opposed depending ribs 88 which snap fit over the arm portions 76*b* of the shelf mounting hook 24 so as to secure them in assembly.

In the functional assembly view of FIG. 10, it can be seen that a "carded" merchandise package 90 is seated in the tray provided by the shelf member 26 and slides forwardly therein by gravity feed so as to display package 90 at the point closest the customer. Another "carded" merchandise package 92 is hung on the fragmentarily illustrated hanger 20 in conventional fashion so as to be displayed vertically.

The display may be readily assembled from its component parts. Initially, a pair of panel mounting brackets 10 are located in the desired position for the upper portion of the panel member 16 and are seated in the perforated panel board 14 by first inserting the finger portions 34 into the holes 12 and then pivoting the brackets downwardly until the flanges 36 abut the surface of the perforated panel board 14. The brackets 10 should be spaced apart a distance greater than half the width of the panel to provide optimum stability.

The panel member 16 is seated upon the brackets 10 by tilting its lower end upwardly and forwardly as the bottom wall 50 of the track portion 46 is seated on the ledges 32 of the brackets 10 and then pivoting the lower end downwardly towards the perforated panel board 14 to engage the projections 40 in the notches 56 of a lower track portion 46. In its mounted position, the panel member 16 will usually abut the surface of the perforated panel board 14 although not necessary, and clearance is shown in the drawings for clarity of illustration.

For purposes of a controlled display arrangement, the merchandiser will normally provide labels 28 which are adhered to the web portions of the front face 42 of the panel member 16 to ensure optimum placement of the articles to be displayed and thus the subassemblies of clips 18 and hooks 20. Generally, these will be disposed adjacent the side margins of the panel member 16 to identify the types of products to be displayed in the "row" defined thereby. Conveniently, the merchandiser will provide a template or planogram (not shown) to facilitate this labelling step.

Clip 18 and hook 20 subassemblies are prepared by inserting the leg portions 74 into the center aperture 68 and pressing the hook 20 downwardly to lock the hook 20 in the aperture 68 and seat it in the channel 70. As will be appreciated, the ribs of the aperture 68 will resiliently deform about the leg portions 74 to provide frictional engagement thereof, and flats (not shown) may be provided on the leg portions 74 to minimize any tendency for rotation.

These subassemblies are then mounted on the panel member 16 by tilting the lower end of the clip 18 upwardly to insert the upper legs 60 into the channel 48 at the desired location and sliding the legs 60 inwardly until the hooks 62 enter the notches 56. The clip 18 is then pivoted downwardly to the position seen in FIG. 7 to slide the lower legs fully into position in the lower channel 48, causing the legs 60, 64 to resiliently deflect and provide frictional engagement with the panel member 16.

Shelf units may also be assembled by snapping the arm portions **76*b* of the shelf mounting hook 24 into the ribs 88 of the shelf member 26. This subassembly is mounted upon a clip member 18 by inserting the pair of leg portions 74*b* into the outermost apertures 68 of the clip member 18. Thereafter, clip member 18 is mounted upon the panel member 16** in the same manner as heretofore described.

Lastly, label hook 20 may be assembled with clip member 18 in a similar fashion and mounted where desired to provide labels and sales information convenient to the purchaser.

As will be readily appreciated, the panel members may be of various sizes, and may have rectangular configurations which are square, horizontally elongated, vertically elongated, or even have configurations other than rectangular. Multiple panels may, and usually will, be mounted on the associated perforated panel board or wall. The illustrated panel members have uniformly spaced track portions but this may be varied for custom display units. As is apparent, the panel members are economically and readily molded from synthetic resin; however, other fabricating techniques may also be employed.

The clip members in the drawings are of uniform dimension and configuration for convenience and minimization of inventory. However, smaller and/or single aperture clip members may be utilized for the hanger hooks and label hooks; moreover, larger clips may be desirable when heavy articles are to be displayed. These clip members are conveniently molded from any one of the many synthetic resins providing the limited resilient deflection.

Similarly, the mounting brackets may be of greater dimension if so desired so as to overlie a greater surface area of the pegboard and seat a greater area of the panel board. More depending flange portions, and even a continuous portion, may be utilized. Although they may be molded from synthetic resin, stamping from metal is preferred because of cost and strength considerations.

Thus, it can be seen from the foregoing detailed description and attached drawings that the merchandise display assembly of the present invention may be readily assembled from conveniently fabricated component parts to provide a rugged, versatile display for goods disposed thereon. Because of the ease of arrangement and rearrangement of all elements of the assembly, the store may readily modify its displays to effect special promotions. Moreover, the display facilitates inventory control.

Having thus described the invention, we claim:

1. A merchandise display assembly for use with a perforated member such as perforated panel board and the like comprising:

A. a plurality of panel mounting brackets each having (i) a body portion providing an upwardly and outwardly inclined ledge and (ii) a multiplicity of spaced finger portions extending upwardly from said body portion and adapted to engage in the apertures of the associated perforated board;

B. a panel member having (i) a front face defined by a multiplicity of web portions lying in a common plane and (ii) vertically spaced track portions extending horizontally therebetween, said track portions providing channels opening at said front face and inclined downwardly therefrom each of said track portions having a bottom wall and a top wall, said track portions being exposed on the rear face of said panel, said inclined ledges of said panel brackets seating the bottom walls of said track portions of said panel member for supporting said panel member on the associated perforated member;

C. a multiplicity of clip members disengageably seated in spaced relationship in said channels of said panel member, said clip members each having (i) a body portion disposed adjacent a web portion of said panel member, (ii) a plurality of laterally spaced upper legs inclined downwardly and inwardly from said body portion and extending into a first channel, and (iii) a lower leg inclined downwardly and inwardly from said body portion and extending into a second channel spaced below said first channel, said legs being configured to seat securely within a vertically spaced pair of said channels, said body portion having a vertically disposed recess therein opening on the upper surface thereof; and D. a multiplicity of display hooks seated in said clip members and each having at least one arm portion extending away from said panel and a depending leg portion on the inner end of said arm portion seated in one of the recesses in said body portions of said clip members.

2. The merchandise display assembly of claim 1 additionally including label members detachably secured to the web portion of said panel member for identifying the products to be displayed on a contiguous hook.

3. The merchandise display assembly of claim 1 additionally including a label hook having at least one arm portion extending away from said panel, a depending leg portion at its one end seated in one of said recesses of one of said clips, and a generally vertically disposed label panel member at its outer end, said label panel being adapted to carry display indicia associated with the products to be displayed on a contiguous display hook.

4. The merchandise display assembly of claim 1 wherein said mounting brackets each have a support flange portion extending downwardly from said body portion to stabilize said bracket.

5. The merchandise display assembly of claim 4 wherein said mounting bracket support flange portion has a projection thereon which seats in the track portion to stabilize the mounting of the panel thereon.

6. The merchandise display assembly of claim 4 wherein said mounting bracket has a flange portion at each end thereof.

7. The merchandise display assembly of claim 1 wherein said panel has side walls at the ends of said front face and wherein each of said track portions has an end wall at the base of said channel.

8. The merchandise display assembly of claim 7 wherein said top wall and end wall of each of said track portions have a multiplicity of recesses spaced therealong opening into said channels and wherein said upper legs of said clips have hook portions engaged in said recesses.

9. The merchandise display assembly of claim 1 wherein said top wall of said track portions is inclined at a steeper angle than said bottom wall to decrease the vertical dimension of said channels at their inner end.

10. The merchandising display assembly of claim 1 including a shelf member having a base wall and sidewall, and a shelf mounting hook having a pair of arm portions with depending leg portions at their inner end seated in a pair of recesses in one of said clip members, said base wall of said shelf member having means thereon engaged with said arm portions of said shelf mounting hook.

11. The merchandising display assembly of claim 10 wherein said arm portions of said shelf mounting hook are inclined downwardly away from said clip member to incline the bottom wall of said shelf member for gravity feed forwardly of articles stored thereon.

12. The merchandising display assembly of claim 10 wherein said engaging means comprises opposed ribs into which said arm portions resiliently snap fit.

13. In a merchandising display assembly, the combination comprising:

A. a display panel for mounting a multiplicity of display elements comprising an integrally molded synthetic resin member having (i) a front face defined by a multiplicity of web portions lying in a common plane and (ii) vertically spaced track portions extending horizontally therebetween, said track portions providing channels opening at said front face and inclined downwardly therefrom, each of said track portions having a bottom wall and a top wall, said track portions being exposed on the rear face of said panel;

B. a multiplicity of clip members disengageably seated in spaced relationship in said channels of said panel member, said clip members each having (i) a body portion disposed adjacent a web portion of said panel member, (ii) a plurality of laterally spaced upper legs inclined downwardly and inwardly from said body portion and extending into a first channel, and (iii) a lower leg inclined downwardly and inwardly from said body portion and extending into a second channel spaced below said first channel, said legs being configured to seat securely within a vertically spaced pair of said channels, said body portion having a vertically disposed recess therein opening on the upper surface thereof; and C. a multiplicity of display hooks seated in said clip members and each having at least one arm portion extending away from said panel and a depending leg portion on the inner end of said arm portion seated in the recess in said body portion in said clip member.

14. The merchandise display assembly of claim 13 wherein said panel has side walls at the ends of said front face and wherein each of said track portions has an end wall at the base of said channel.

15. The merchandise display assembly of claim 13 wherein said top wall of said track portions is inclined at a steeper angle than said bottom wall to decrease the vertical dimension of said channels at their inner end.

16. In a merchandise display assembly, the combination comprising:

A. a pluraltiy of panel mounting brackets each having (i) a body portion providing an upwardly and outwardly inclined ledge and (ii) a multiplicity of spaced finger portions extending upwardly from said body portion and adapted to engage in the apertures of an associated perforated upon which mounted; and B. a panel member having (i) a front face defined by a multiplicity of web portions lying in a common plane and (ii) vertically spaced track portions extending horizontally therebetween, said track portions providing channels opening at said front face and inclined downwardly therefrom each of said track portions having a bottom wall and a top wall, said track portions being exposed on the rear face of said panel, said inclined ledges of said panel brackets seating the bottom walls of said track portions of said panel member for supporting said panel member on the associated perforated board.

17. The merchandising display assembly of claim 16 additionally including a multiplicity of clip members disengageably seated in spaced relationship in said channels of said panel member, said clip members each having (i) a body portion disposed adjacent a web portion of said panel member, (ii) a plurality of laterally spaced upper legs inclined downwardly and inwardly from said body portion and extending into a first channel, and (iii) a lower leg inclined downwardly and inwardly from said body portion and extending into a second channel spaced below said first channel, said legs being configured to seat securely within a vertically spaced pair of said channels, said body portion having a vertically disposed recess therein opening on the upper surface thereof.

18. The merchandise display assembly of claim 16 wherein said mounting brackets each have a support flange portion extending downwardly from said body portion to stabilize said bracket.

19. The merchandise display assembly of claim 18 wherein said mounting bracket flange portion has a projection thereon which seats in the track portion to stabilize the mounting of the panel thereon.

20. The merchandise display assembly of claim 18 wherein said mounting bracket has a flange portion at each end thereof.

21. In a merchandising display assembly, the combination comprising:

A. a display panel for mounting a multiplicity of display elements comprising an integrally molded synthetic resin member having (i) a front face defined by a multiplicity of web portions lying in a common plane, (ii) vertically spaced track portions extending horizontally therebetween, said track portions providing channels opening at said front face and inclined downwardly therefrom, each of said track portions having a bottom wall and a top wall, said track portions being exposed on the rear face of said panel and having an end wall at the base of said channel, said top wall and end wall of each of said track portions having a multiplicity of recesses spaced therealong opening into said channels, and (iii) side walls at the ends of said front face; and B. a multiplicity of clip members disengageably seated in spaced relationship in said channels of said panel member, said clip members each having (i) a body portion disposed adjacent a web portion of said panel member, (ii) a plurality of laterally spaced upper legs inclined downwardly and inwardly from said body portion and extending into a first channel, said upper legs of said clip members having hook portions engaged in said recesses of said track portions, and (iii) a lower leg inclined downwardly and inwardly from said body portion and extending into a second channel spaced below said first channel, said legs being configured to seat securely within a vertically spaced pair of said channels, said body portion having a vertically disposed recess therein opening on the upper surface thereof.

* * * * *